United States Patent [19]

Devlin

[11] 4,022,361

[45] May 10, 1977

[54] HOLSTER FOR A CONCEALED WEAPON

[76] Inventor: Daniel H. Devlin, 17635 N. 42nd St., Phoenix, Ariz. 85032

[22] Filed: Apr. 5, 1976

[21] Appl. No.: 673,962

[52] U.S. Cl. ..... 224/2 B; 224/5 H; 224/26 R

[51] Int. Cl.[2] ..... F41C 33/02

[58] Field of Search ..... 224/2 B, 2 C, 2 D, 2 E, 224/2 F, 3, 1 R, 5 R, 5 C, 5 H, 26 R, 26 B, 26 C, 26 D, 26 F, 26 H, 26 J, 26 K, 27, 4 A, 4 B, 4 C

[56] References Cited

UNITED STATES PATENTS

| | | | |
|---|---|---|---|
| 744,517 | 11/1903 | Eldred | 224/5 R |
| 3,583,612 | 6/1971 | Theodore | 224/2 B |
| 3,642,183 | 2/1972 | Boren | 224/2 B |
| 3,977,583 | 8/1976 | Bianchi | 224/2 B |

*Primary Examiner*—L. J. Paperner
*Assistant Examiner*—Jerold M. Forsberg
*Attorney, Agent, or Firm*—Drummond, Nelson & Ptak

[57] ABSTRACT

A holster for carrying a concealed weapon is disclosed. A holster case is secured to a sling. The upper end of the sling carries fastening means which can be detachably secured to the inner side of the belt of the wearer with the holster and gun concealed within the trousers and beneath the shirt of the wearer. In the preferred embodiment a fabric fastener of the cooperating loop and hook fastener material is utilized to secure the sling to the wearer's belt.

5 Claims, 9 Drawing Figures

HOLSTER FOR A CONCEALED WEAPON

The present invention relates to a holster. More particularly the invention relates to a holster for a concealed weapon such as a handgun which is adapted to be worn in a concealed position inside the top of the trousers of the wearer.

It is often necessary in law enforcement work for plainclothes and non-uniformed officers to carry a concealed weapon. One reason law enforcement personnel prefer to carry a concealed weapon is to prevent their recognition by the public of their official status. Often investigations are impeded once the officer's status is revealed.

Another reason for concealing weapons is due to the psychology of firearms. A non-uniformed or off-duty officer in plainclothes may often carry a handgun. Individuals in public places seeing or detecting a handgun carried by such an individual often become wary, uncooperative and in some cases aggressive. Therefore, it is generally preferred by law enforcement officers in plainclothes to carry the weapon in such a way that it is concealed yet in a position available for use if necessary.

One common way in which handguns are concealed are by special holsters which are strapped to the side or body of the wearer. The user wears an outer garment such as a jacket or suit coat and the holster and weapon are concealed beneath the coat. However, if the wearer should take off his coat or leave it unbuttoned, the gun is often visible to the public.

Another holster for concealing a gun found in the prior art includes a holster body having an attached clip or strap which affixes to the belt of the wearer. The holster is inserted beneath the belt or inside the trouser waistband of the wearer. The clip attaches over the waistband and belt to secure the holster and contained weapon in place. The disadvantage of holsters of this type is that a substantial portion of the holster is often exposed at the belt of the wearer drawing attention to the attached weapon.

Accordingly, there exists a need for a holster which serves to conveniently and comfortably conceal both the holster and weapon from view.

Briefly, the preferred embodiment of the present invention, which will be described in greater detail hereafter, includes a holster case which forms a pistol receiving compartment. A sling or strap support is either permanently or detachably secured to the case near the bottom of the case and extends upwardly along the outer side of the holster case. The upper end of the sling is reversebly bent and forms a belt engaging tab. The outer face of the belt engaging tab is provided with suitable fastener portion which cooperates with a fastener portion provided on the inner side of the wearer's belt. In use, the belt engaging tab is secured to the inner face of the wearer's belt with the holster case and gun depending beneath the wearer's trousers. To further conceal a weapon, the wearer can insert a lower marginal portion of his shirt between the holster and the sling to conceal the weapon and holster case. In the preferred embodiment, loop and hook fastener material is utilized to secure the upper end of the support to the wearer's belt.

Other objects and advantages of the present invention will become apparent to those skilled in the art to which the invention pertains upon reference to the following detailed description. The description refers to the accompanying drawings in which like reference numerals refer to like parts throughout the several views and in which.

Figure 1:
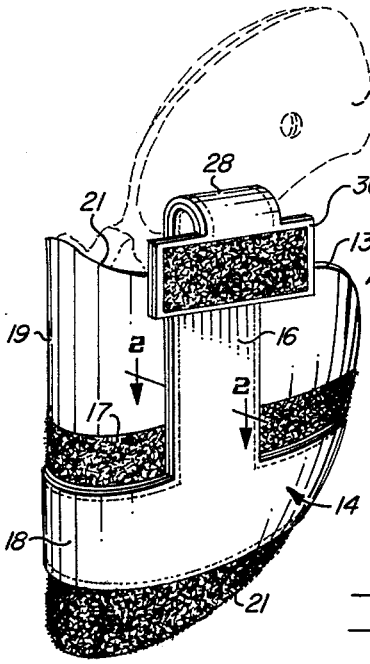
FIG. 1 is a perspective view of the holster of the present invention as viewed from the outer side of the holster.

Referring now to the drawings, the holster assembly of the present invention generally designated by the numeral 10. Holster assembly 10 includes a holster case 12 which defines a compartment 13 for receiving a pistol 15. The holster case having opposite outer and inner sides 17 and 19, respectively. The term "inner" refers to the side of the holster normally worn adjacent the body. The holster case is shown as being leather, preferably two-ply, and formed and stitched having dimensions and shaped to accommodate a particular handgun. For example, the holster illustrated in the accompanying patent drawings is especially designed for a Smith and Wesson .38 Caliber Chief Special. It will be obvious that the particular shape and dimensions of the holster can be varied in accordance with the physical size and dimensions of the pistol to be carried. For example, the holster case 12 is shown having a closed lower end. However, for a longer barrel, the lower end could be open to accept the barrel end.

Figure 3:
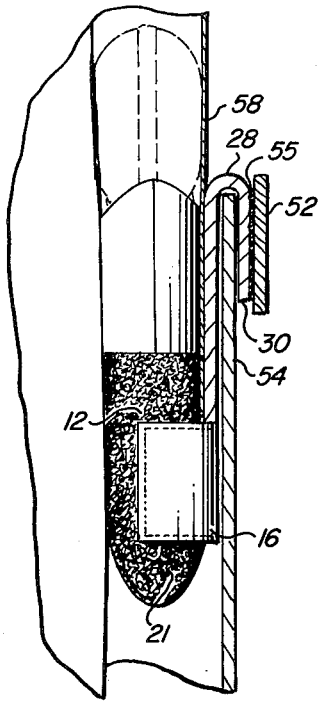
FIG. 3 is a front view illustrating the holster in a position of use with the trousers, shirt and belt of the wearer shown in section.
Figure 4:
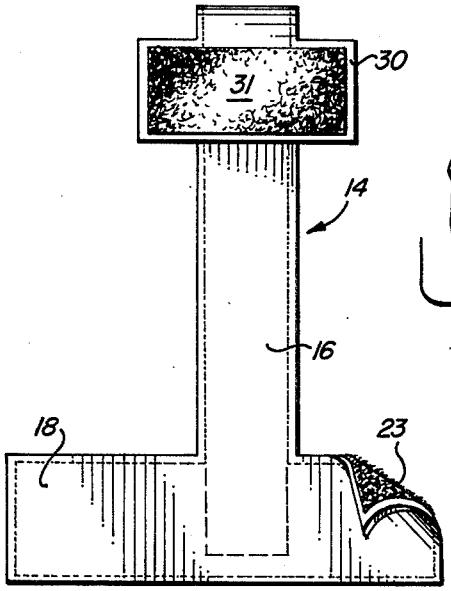
FIG. 4 is a plan view showing the sling or support separated from the holster in a flat position.
Figure 6:
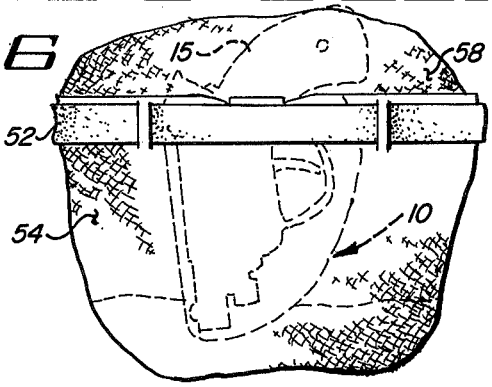
FIG. 6 is a view of the holster of the present invention attached to a belt of the wearer and concealed within the waistband beneath the shirt of the wearer.

As is conventional, when the pistol 15 is inserted in the compartment 13 of the holster, the butt projects from above the holster as seen in FIGS. 1, 3 and 6. The trigger guard and hammer are preferably both shielded by the holster case. It is also possible to construct the holder from synthetic materials such as heavy guage vinyl with edges appropriately joined by heat sealing or dielectric methods.

The holster case 12 is held in place inside the upper portion of the wearer's trousers by a sling or support 14. Sling 14 includes an elongate strap 16 which extends along the outside 17 of the holster case 12 and upwardly beyond the upper edge 21 of the case. The lower end of the strap 16 is secured to the inner side of the holster at transverse holster attaching strip 18. The strip 18 is integrally formed with strap 16 and preferably has a transverse width greater than one side of the holster so that it can be wrapped about the holster case. In the preferred embodiment, the outer side 17 of the holster is covered with a layer of fabric fastening material 21 which has two mating fabric portions which form a separable fastener. One type of this material is commonly sold under the trademark VELCRO and is characterized by loop and hook mating portions. The term "loop and hook" is used in the specification and claims to designate separable fabric fasteners of the general type described.

Figure 5:
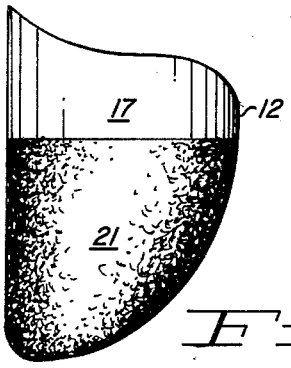
FIG. 5 is a side view showing the outer side of the holster case.

As best seen in FIGS. 1 and 5, the fastening material 21 covers the outer side of the holster to approximately the vertical mid-point. Inner side of strip 18 also is provided with a layer of cooperating loop and hook material so that strip 18 can be secured to the holster at area 21. This is done by simply engaging the loop and hook portions 21 and 23 carried on the strip and the holster. The position of the sling 16 relative to the holster case 12 can be vertically adjusted in accordance with the preference of the wearer. The angular position of the holster relative to the sling is also adjustable permitting the user to position the holster for maximum convenience and comfort in accordance with the personal preference and physical requirements of the wearer. It may also be desirable to provide loop and fastener material on both the inner and outer sides of the holster cases 12 so that the holster is reversible.

The upper end of sling 16 is reversely bent in a U-shape at bight 28 so that a fastener tab 30 is formed. Fastener tab 30 may have a transverse width greater than strap 16 for securing the holster to the belt of the wearer. Fastener tab 30 also is provided with a strip of loop and hook material 31 which is detachably securable at a cooperable strip of material on the inside of the wearer's belt as will be explained hereafter.

Figure 2:
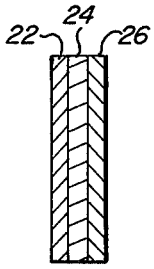
FIG. 2 is a partial sectional view taken along line 2—2 of FIG. 1.

As best seen in FIG. 2, sling 14 and fastener tab are preferably formed with a metal insert 24 stitched between opposite layers of leather 22 and 26. The metal insert serves to give the strap strength and rigidity particularly at bight 28 and fastener tab 30. Rigidity of strap 16 also helps to maintain the holster case 12 in place when the weapon is removed.

The use of the holster of the present invention is best illustrated in FIGS. 3 and 6. FIG. 3 is a view partly in section illustrating the holster of the present invention attached to a belt 52 and concealed beneath the waistband 54 of the wearer's trousers and a portion of the wearer's shirt 58. A strip of loop and hook material 55 is secured to the inner face of the wearer's belt 52. This may be done by stitching or appropriately bonding the material to the belt surface at a peripheral location where the wearer wishes to carry his weapon. The sling 14 is secured to the holster case 12 by engaging the fastener material 23 on the tab 18 to the cooperating fastener material 21 on the inner side 17 of the holster case. The holster is then inserted along the inside of the wearer's trousers with the bight 28 of the sling extending over the upper edge of the waistband of the wearer's trousers. The fastener tab 30 is inserted beneath the belt 52 with the loop and hook material 31 engaging the loop and hook material 55 on the belt. The lower marginal portion of the wearer's shirt 58 can be inserted between the outer face 17 of the holster case and strap 16 to cover the holster and exposed portion of the pistol 15. It will be seen that when the holster and gun are in this position, they are securely held in place by the wearer's belt and by pressure exterted by the body of the wearer. Similarly the wearer's shirt is also secured between the holster case and sling even when extreme physical movement occurs. The construction of the strap 16 assists to secure the holster against unwarranged movement or displacement when the pistol is withdrawn from the holster case 12. It will be noted that the only part of the holster exposed is the bight portion 28 which bridges the upper edge of the wearer's trousers. However, as a practical matter, even this portion will normally be obscured from view as the weight of the holster and gun will tend to compress the trouser material so that the bight 28 will be concealed or partially obscured behind the wearer's belt 52.

It will be apparent that the holster of the present invention can be used with no modification with garments such as beltless trousers. In this instance, a suitable fastener, such as a loop and hook fastener, could be affixed to the interior of the trouser waistband and the holster carried as discussed above.

With the holster as shown, which is particularly designed for a short barrel type of handgun commonly used by detectives and other law enforcement officials, the holster and gun occupy a relatively small bulk so that the weapon should not be noticeable or visible to the casual observer. The relationship of the sling 16 and the holster case 12 further aids in concealment since the upper portion of the sling can be separated or pulled away from the holster so that the wearer's shirt can be inserted to further conceal the weapon. However, even though the weapon is concealed, the wearer has convenient access to the weapon at all times if necessary.

Figure 7:
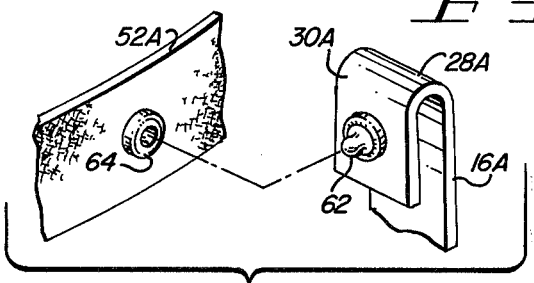
FIG. 7 is a fragmentary perspective view illustrating an alternate means of attaching the strap to the belt of the wearer.

FIG. 7 shows an alternate way of attaching the holster supporting strap 16A to the wearer's belt 52A. In this embodiment the upper portion of the strap 16A is constructed as has been previously described with a reversely bent bight portion 28A and a fastener tab portion 30A. The fastener tab portion 30A carries a snap having male projection 62 which is engageable and cooperating snap portion 64 secured at the inner face of the wearer's belt 52A.

Figure 8:
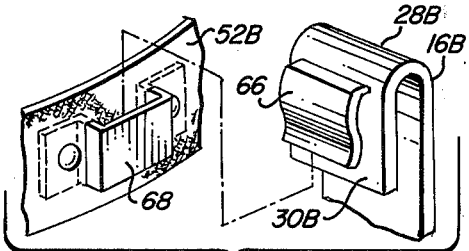
FIG. 8 is a fragmentary perspective view showing still another means of attaching the strap to the belt of the wearer.

FIG. 8 shows still another form of the fastener for releasably securing the upper end of the holster strap 16B to the belt 52B of the wearer. Strap 16B is constructed as has been described above. Bight portion 28B is adapted to extend over the upper portion of the wearer's trousers. Tab 30B carries a hook 66 which can be inserted in cooperating bracket 68 which is secured to the inner face of the wearer's belt 52B.

Figure 9:
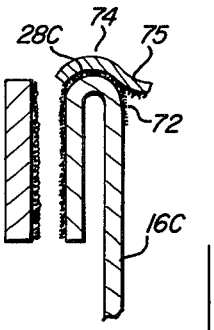
FIG. 9 is a sectional view illustrating another feature of the present invention in which a swatch of material can be applied to the strap to further conceal the the holster from view.

FIG. 9 shows a further modification of the holster sling shown in FIG. 1. In this embodiment a bight portion 28C of the sling 16C is provided with a layer fastener material 72 of the loop and hook type. A separate patch of material 74 has cooperating loop and pile type fastening material 75 on its inner face. The material 74 can be secured over the bight portion 28C by engaging fastening portions 74 and 72. It is intended that the patch of material 74 would be selected to match the color and pattern of the fabric of the wearer's trousers so that patch 74 would serve to conceal the bight portion of the strap 16C making visual detection of the holster very difficult.

Thus, it will be seen that the present invention provides a unique holster for carrying concealed handguns. In use, the holster and gun are almost totally obscured from sight with no part of the holster being readily visible to the casual observer. The holster and gun are carried in a convenient position so that the gun can be quickly withdrawn from the holster if necessary. The holster can be configured to accommodate any type of handgun and can be constructed from various materials such as leather or plastic. In the preferred embodiment, the holster sling has been shown as being detachably secured to the lower portion of the holster case. It will be obvious that the holster sling could be permanently affixed to the holster case by stitching or by application of an adhesive. Also in the preferred embodiment, the fastener portions are shown as loop and hook material but other fasteners, for example as shown in FIGS. 7 and 8, could be used with facility.

While particular embodiments of the present invention have been shown and described, it is not intended to limit the invention to the exact details of construction set forth herein. It will be obvious to those skilled in the art to make various changes, modifications and alterations and to the extent that these changes, modifications and alterations do not depart from the spirit and scope of the appended claims, they are intended to the encompassed therein.

I claim:

1. A holster for supporting a handgun in a concealed position inside the trouser waistband of a wearer and suspended from the belt of the wearer at first fastener means at the inner side of said belt, said holster comprising:

a. a holster case defining a pistol receiving compartment, said holster case having first and second opposite sides; and b. an elongate supporting strap having opposite upper and lower ends, said strap extending along the exterior of the first side of said holster case and secured to said holster case at said first side at a location near the lower end of the strap, the upper end of said strap being reversely bent forming a bight and a mounting tab, the outer surface of said mounting tab having second fastening means associated therewith cooperable with said first fastening means whereby the holster case can be positioned within the trousers of the wearer with said tab interposed between the belt and trousers with said first and said second fastening means detachably engaged, said tab is substantially concealed from view between the belt and trousers and whereby said strap and the outer side of said holster can be partially separated so the wearer's shirt can be inserted therebetween to conceal the holster.

2. The holster of claim 1 wherein said first and second fastening means comprise mating portions of a loop and pile fastener material.

3. The holster of claim 1 wherein said first and second fastener means comprise male and female interengaging members.

4. The holster of claim 1 wherein said strap is leather reinforced with a metal insert.

5. The holster of claim 2 wherein fastener material extends at least over the bight of said strap tab and further including a patch of material having mating fastener material therein which can be applied over the bight to further conceal the strap.

* * * * *